US009314076B2

(12) United States Patent
Edme et al.

(10) Patent No.: US 9,314,076 B2
(45) Date of Patent: Apr. 19, 2016

(54) TRAVEL SUITCASE SYSTEM

(71) Applicants: Colson Edme, Brooklyn, NY (US); Ginette Aubin-Edme, Brooklyn, NY (US)

(72) Inventors: Colson Edme, Brooklyn, NY (US); Ginette Aubin-Edme, Brooklyn, NY (US)

( * ) Notice: Subject to any disclaimer, the term of this patent is extended or adjusted under 35 U.S.C. 154(b) by 80 days.

(21) Appl. No.: 14/068,488

(22) Filed: Oct. 31, 2013

(65) Prior Publication Data

US 2015/0114777 A1 Apr. 30, 2015

(51) Int. Cl.

| | |
|---|---|
| ***A45C 5/14*** | (2006.01) |
| ***A45C 7/00*** | (2006.01) |
| ***A45C 13/26*** | (2006.01) |
| ***A45C 13/10*** | (2006.01) |

(52) U.S. Cl.

CPC ..... *A45C 7/0045* (2013.01); *A45C 5/14* (2013.01); *A45C 13/1069* (2013.01); *A45C 13/262* (2013.01); *A45C 2013/267* (2013.01)

(58) Field of Classification Search

CPC .... A45C 5/14; A45C 13/1069; A45C 13/123; A45C 2013/267

USPC ..... 190/18 A, 102, 108, 115, 117; 206/818; 294/65.5; 383/37, 15; 290/25.1; 16/113.1, 405

See application file for complete search history.

(56) References Cited

U.S. PATENT DOCUMENTS

| | | | | |
|---|---|---|---|---|
| 1,084,360 | A | 1/1914 | Rahm | |
| 2,372,845 | A | 4/1945 | Nelson | |
| 2,428,906 | A | 10/1947 | Cannella | |
| 2,732,969 | A | 1/1956 | Browne | |
| 2,858,957 | A | 11/1958 | Darrah | |
| 3,319,744 | A | 5/1967 | Smith | |
| 3,606,372 | A | 9/1971 | Browning | |
| 3,823,973 | A * | 7/1974 | Ramer | 294/68.26 |
| 3,974,898 | A | 8/1976 | Tullis et al. | |
| 4,122,925 | A | 10/1978 | Schultheiss | |
| 4,262,829 | A * | 4/1981 | Hine, Jr. | B62J 9/00 224/417 |
| 4,346,863 | A * | 8/1982 | Zeitrager et al. | 248/75 |
| 4,673,070 | A | 6/1987 | Ambal | |
| 4,693,345 | A | 9/1987 | Mittelmann | |
| 4,743,038 | A * | 5/1988 | Myers et al. | 280/40 |
| 4,744,446 | A | 5/1988 | Arney | |
| 4,836,343 | A | 6/1989 | Arney | |
| 5,099,968 | A | 3/1992 | Kikuchi | |
| 5,186,290 | A * | 2/1993 | Takayama | 190/108 |
| 5,472,084 | A | 12/1995 | Aliano, Jr. | |
| 5,971,119 | A * | 10/1999 | Chi | 190/108 |
| 6,073,737 | A * | 6/2000 | Kang | 190/18 A |
| 6,213,266 | B1 | 4/2001 | Hollingsworth | |
| 6,431,589 | B1 * | 8/2002 | Heigl et al. | 280/730.2 |
| 6,446,688 | B1 * | 9/2002 | Sutton | A45C 3/08 150/105 |
| 6,499,638 | B2 * | 12/2002 | Campbell | B62J 9/001 190/18 A |
| D472,385 | S | 4/2003 | Bauer | |

(Continued)

FOREIGN PATENT DOCUMENTS

| | | | |
|---|---|---|---|
| DE | 3211413 | A1 | 12/1983 |
| DE | 3636064 | A1 * | 4/1988 |

(Continued)

*Primary Examiner* — Sue A Weaver

(74) *Attorney, Agent, or Firm* — Cowan, Liebowitz & Latman, P.C.

(57) ABSTRACT

An improved travel suitcase system having at least two travel suitcases, in which each of the travel suitcases has installation parts thereon that allow the suitcases to be coupled together so that the suitcases, when coupled together, can be easily moved at the same time.

9 Claims, 6 Drawing Sheets

(56) References Cited

U.S. PATENT DOCUMENTS

| | | | | |
|---|---|---|---|---|
| 7,909,149 | B2 | 3/2011 | Marji | |
| D671,316 | S | 11/2012 | Kritzler | |
| 8,936,140 | B2 * | 1/2015 | Herold | 190/108 |
| 2002/0195359 | A1 | 12/2002 | Uner et al. | |
| 2003/0145927 | A1 * | 8/2003 | Lee | 150/107 |
| 2004/0173447 | A1 * | 9/2004 | Lee | 200/512 |
| 2005/0199459 | A1 * | 9/2005 | Harvey | 190/108 |
| 2006/0260893 | A1 * | 11/2006 | Drew et al. | 190/108 |
| 2008/0086846 | A1 | 4/2008 | Wemmer | |
| 2008/0128231 | A1 * | 6/2008 | Newman | 190/108 |
| 2008/0308369 | A1 | 12/2008 | Louis, Sr. | |
| 2009/0139811 | A1 * | 6/2009 | Mochihara | 188/268 |
| 2009/0301833 | A1 * | 12/2009 | Hymas | 190/18 A |
| 2010/0059323 | A1 * | 3/2010 | Marji | 190/18 A |
| 2010/0147642 | A1 * | 6/2010 | Andochick | 190/18 A |
| 2010/0236886 | A1 * | 9/2010 | Herold | 190/18 A |
| 2011/0011503 | A1 * | 1/2011 | Parker | A45C 3/08 150/104 |
| 2012/0124791 | A1 * | 5/2012 | Hasegawa | A44B 17/0076 24/596.1 |
| 2012/0228074 | A1 * | 9/2012 | Osler | 190/18 A |
| 2013/0175129 | A1 * | 7/2013 | Rankin | A45C 7/0045 190/18 A |
| 2013/0213753 | A1 * | 8/2013 | Salek | 190/18 A |
| 2013/0333996 | A1 * | 12/2013 | Selvi | 190/18 A |

FOREIGN PATENT DOCUMENTS

| | | | |
|---|---|---|---|
| DE | 3934760 | A1 | 4/1991 |
| WO | WO 9935931 | * | 7/1999 |

* cited by examiner

TRAVEL SUITCASE SYSTEM

FIELD OF THE INVENTION

The present invention relates to an improved travel suitcase system, and particularly relates to a system of multiple travel suitcases and a manner of connection between such multiple travel suitcases.

BACKGROUND OF THE INVENTION

With the development of social progress and global economic integration, leisure travel and business trips become more and more frequent. Usually, many types of items need to be taken on such trips, including clothing, cosmetics, personal bathroom items, documents, product samples, etc. Hence, a suitable travel suitcase has now become an indispensable item for individuals who travel frequently. Currently available suitcases generally include a body, sliding wheel(s), a pull handle, and other components. With sliding wheels and a pull handle, a travel suitcase is easily moved by pulling (or sometimes pushing) the handle.

However, a single travel suitcase often is not sufficient for many travelers, and thus individuals often need to utilize two or more suitcases. Commonly, travelling with multiple suitcases is undesirable, due to an individual's general inability to handle multiple suitcases simultaneously, the possibility of losing a suitcase, for example, in very crowded locations, and other reasons.

Accordingly, the inventors hereof have recognized that there is a need to provide techniques/systems that address the above-mentioned problems when travelling with multiple suitcases.

SUMMARY OF THE INVENTION

As set out in further detail below, the present invention entails, in summary, in accordance with an embodiment, an improved travel suitcase system comprising first and second suitcases, each of the first and second suitcases having a respective set of wheels, each of the first and second suitcases having a respective installation part, the installation part of the first suitcase and the installation part of the second suitcase being releasably coupled to one another so that the first and second suitcases, when coupled by the respective installation parts, are movable together.

As an aspect of the invention, the installation part of the first suitcase is disposed on a side face of the first suitcase; and the installation part of the second suitcase is disposed on a side face of the second suitcase that is opposite of the side face of the first suitcase when the first and second suitcases are coupled together.

As another aspect, the first installation part is disposed on a topside of the first travel suitcase; and the second installation part is disposed on an underside of the second travel suitcase that is opposite the topside of the first travel suitcase when the first and second suitcases are coupled together.

As a further aspect, the system further comprises a positioning part that fixes the first installation part to the second installation part.

As yet another aspect, each of the first and second suitcases includes a respective handle, the respective handles of the first and second suitcases being disposed on respective facing surfaces of the first and second suitcases when the first and second suitcases are coupled together, and wherein the handles of the first and second suitcases are adjacent to one another and parallel to one another when the first and second suitcases are coupled together.

As a feature of this aspect, the handles of the first and second suitcases are extendable type handles, and wherein a user is able to hold both handles with a single hand when the first and second suitcases are coupled together.

As another feature of this aspect, the handle of the first suitcase is disposed on the installation part of the first suitcase, and the handle of the second suitcase is disposed on the installation part of the second suitcase.

As a further feature, the first and second suitcases, when coupled together, are immediately adjacent to one another in a manner wherein there is no gap between the first and second suitcases.

As a particular feature of this feature, the handles of the first and second suitcases are extendable type handles, and wherein a user is able to hold both handles with a single hand when the first and second suitcases are coupled together.

As yet a further feature, the system further includes a connecting piece attached to both of the handles of the first and second suitcases.

As yet an additional feature, the system includes a magnetic-type connector system wherein the first and second suitcases are coupled together by said magnetic-type connector system.

As another feature, the handle of at least one of the first and second suitcases includes therein a magnet for connecting to the handle of the other suitcase.

As a further feature, the handle of at least one of the first and second suitcases includes therein magnet along its length for connecting to the handle of the other suitcase.

Various other objects, advantages and features of the present invention will become readily apparent to those of ordinary skill in the art from the following detailed description of the invention.

BRIEF DESCRIPTION OF THE DRAWINGS

The following detailed description, given by way of example and not intended to limit the present invention solely thereto, will best be appreciated in conjunction with the accompanying drawings, wherein like reference numerals denote like elements and parts, in which.

DETAILED DESCRIPTION OF THE PRESENT INVENTION

The detailed description herein is presented with reference to various embodiments and depictions, which are provided as exemplary and not intended to be exhaustive. Accordingly, other embodiments and variations described herein are deemed to be within the scope of the invention.

As will be appreciated from the description herein, the present invention entails the particular interconnection between two travel suitcases, wherein upon such interconnection, the connected suitcases may be easily moved in a desired direction by an individual exerting force on one (or both) of the handles. Other features and advantages also are described as part of the invention. Accordingly, by employing the present invention, travelers are able to more easily transport multiple suitcases, thus saving time, effort and reducing the chance of the loss of a suitcase, as further discussed herein.

Figure 1:
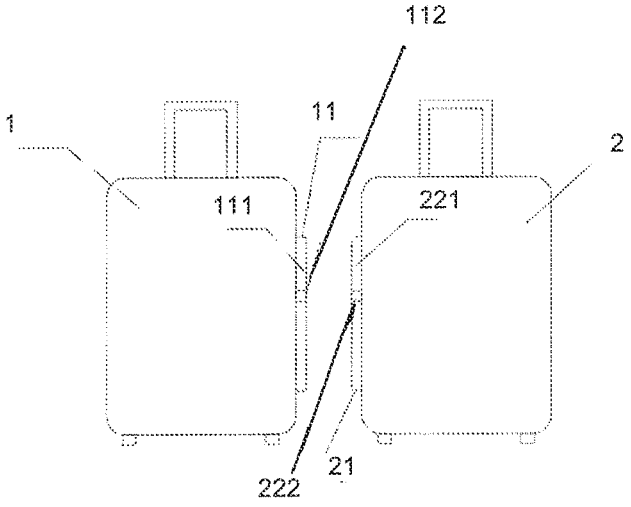
FIG. 1 is a schematic illustration that shows the improved travel suitcase system of the present invention.

Referring now to the figures, FIG. 1 thereof is a schematic illustration that shows the improved travel suitcase system of the present invention. As shown, the system comprises two improved suitcases (hereinafter, also referred simply as "suitcases"), shown in a side-by-side, but unattached, configuration, in accordance with the present invention. Each suitcase herein described includes a set of wheels at its bottom. Two wheels or four wheels may be disposed on the bottom of each suitcase (e.g., disposed on the bottom of each suitcase shown in FIG. 1 and the other figures).

Figure 2:
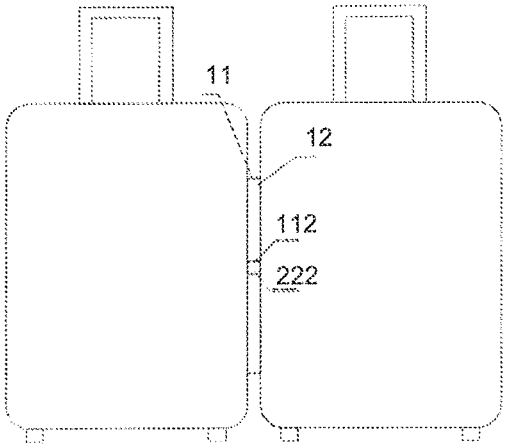
FIG. 2 is a schematic illustration of the two travel suitcases, shown in a connected configuration, in accordance with the present invention.

As shown in FIG. 1, two improved travel suitcases 1 and 2 are shown. In accordance with the present, each suitcase includes a respective installation part that enables the suitcases to be coupled together, as herein described. In particular, an installation part 11 is equipped on travel suitcase 1, and an installation part 21 is equipped on travel suitcase 2. When installation parts 11 and 21 are connected, two travel suitcases may be moved together, thus making it highly convenient to move such two travel suitcases simultaneously. FIG. 2 is a schematic illustration that shows the two improved travel suitcases of the present invention connected together.

Referring to both FIGS. 1 and 2, installation part 11 is shown equipped on one side of travel suitcase 1, and installation part 21 is shown equipped on a side of travel suitcase 2 that is opposite to the side to which installation part 11 is equipped. With such configuration, the aforementioned connection of installation part 11 and 21 makes it convenient to move two parallel, juxtaposed travel suitcases together.

In connection with the embodiment described with references to FIGS. 1 and 2, as well as to the other embodiments described herein, the present invention is described as employing and interconnecting two travel suitcases. However, more than two travel suitcases may be employed. For example, three or more travel suitcases may be interconnected in accordance with the various embodiments described herein so that several (e.g., 3, 4, 5, etc.) suitcases may be handled by an individual in a relatively easy manner.

Figure 3:
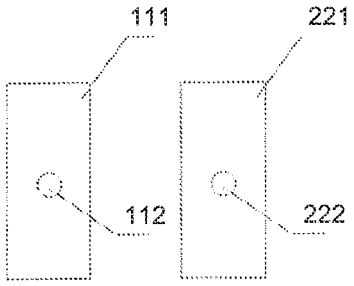
FIG. 3 is a schematic illustration of fixing plates of the improved travel suitcase system of the present invention.

FIG. 3 is a schematic illustration of fixing plates of the improved travel suitcase system of the present invention. In accordance with the invention, the above-mentioned installation part 11 may be a first fixing plate 111, and mounting hole 112 shown in FIG. 3 is equipped on first fixing plate 111. It is noted that mounting hole 112 may entail several mounting holes. In addition, installation part 21 may be a second fixing plate 221, and mounting hole 222 is equipped on second fixing plate 221. Likewise, mounting hole 222 may be several mounting holes. Accordingly, travel suitcases 1 and 2 may be connected using mounting holes 112 and 222. It is noted that other manners of interconnection may be employed, as would be appreciated by those of ordinary skill in the art, and thus the manner of interconnection is not limited to mounting holes.

Figure 4:
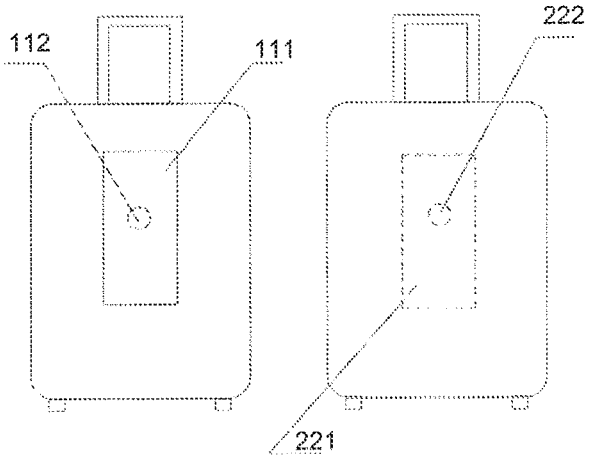
FIG. 4 is a schematic illustration of the location of the fixing plates on travel suitcases in accordance with the present invention.

Referring to FIG. 4, a schematic illustration of fixing plates 111 and 221 on the improved suitcases of the present invention is shown. As shown in FIG. 4, first fixing plate 111 is equipped on the topside of travel suitcase 1, and second fixing plate 221 is equipped on the opposite, underside of travel suitcase 2 (broken lines represent the underside of the suitcase—with the view being the top view of the suitcases). With such configuration, the installation parts make it convenient to connect the suitcases together thus allowing an individual to move the two suitcases (or more than two suitcases) together.

Furthermore, to keep the travel suitcases in a more stable configuration, a positioning part may be utilized on the first and second installation parts. Such a positioning part is further discussed below.

Figure 5:
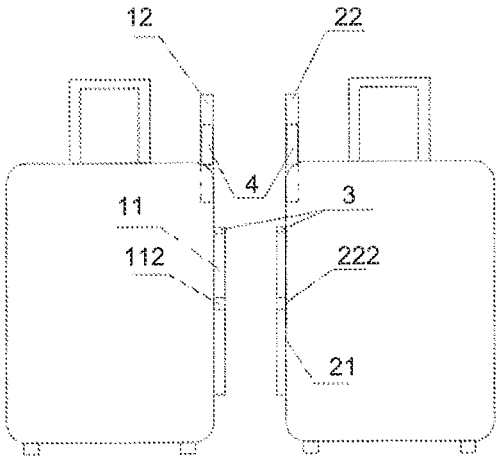
FIG. 5 is a further schematic illustration of the improved travel suitcase system of the present invention

FIG. 5 shows another schematic illustration of the present invention. As shown in FIG. 5, travel suitcase 1 includes on a side an extendable, first handle 12, and travel suitcase 2 includes an extendable, second handle 22 on a side of travel suitcase 2. In accordance with the present invention, the sides of the two suitcases in which the handles 12, 22 are disposed face one another such as shown in FIG. 5. Then, when the two suitcases are connected, the sides on which the extendable handles are disposed are joined together. In such configuration, the two suitcases are joined together in a manner in which the handles of the two cases are adjacent to one another. In such arrangement, a person is able to hold both handles at the same time with a single hand, if desired.

Moreover, in such joined configuration, the two handles are disposed in the center of the combined suitcases and since both handles are in the center, there is a substantially equal weight distribution on each of side of the handles. That is, the combined structure avoids an asymmetric weight distribution. In other words, the amount of weight in front and behind the handles is roughly the same (assuming the weight of the two suitcases are roughly the same). Accordingly, during movement of the combined suitcases, the entire structure is reasonably well balanced amongst all of the wheels of the suitcases thus minimizing the chance that the suitcases will fall over during movement. Therefore, an individual is able to easily move the two combined suitcases.

Figure 6:
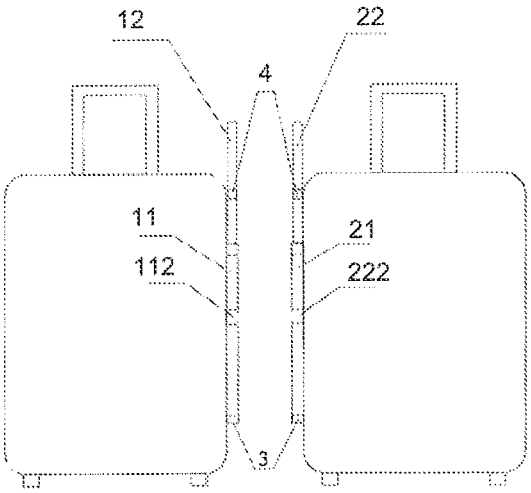
FIG. 6 is another schematic illustration of the improved travel suitcase system of the present invention.

FIG. 6 is yet another illustration of the improved travel suitcase system of the present invention. As shown in FIG. 6, first handle 12 may be equipped parallel to first installation part 11, and second handle 22 may be equipped parallel to second installation part 21. Accordingly, multiple suitcases may be connected wherein there is a seamless interconnection between the two handles 12 and 22 of the two suitcases. That is, in such configuration, there is no gap between the two suitcases when connected together. Moreover, each handle may be disposed on or be a part of the installation parts themselves.

In addition, handles 12 and 22 may be connected using a connecting piece 4, wherein connecting piece 4 may be a strong magnet that magnetically couples the two handles 12 and 22 together. However, connecting piece 4 may be comprised of multiple magnetics disposed at the location shown in FIGS. 5 and 6, but may be disposed at other locations as well. Further, multiple magnetic connectors may be disposed at multiple locations along the handles.

In addition, in certain variations, each handle 12 and 22 of the two suitcases may have embedded therein magnetics disposed along the entire length (or along most of the length) of each of the handles. The magnets may be hidden so that they are not visible. The magnet or magnets may be used without an additional connecting piece 4 and, optionally, may be used without a positioning piece 3. Positioning piece 3 (comprised of respective components on each suitcase) enables the two suitcases to be properly aligned when joined together.

Figure 7:
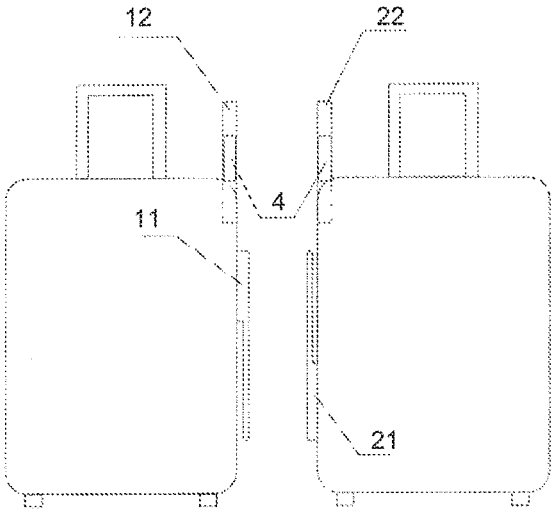
FIG. 7 is yet a further schematic illustration of the improved travel suitcase system of the present invention.

FIG. 7 shows another illustration of the present invention. As shown in FIG. 7, first installation part 11 and second installation part 21 includes and is connected by plug-in parts. A first-type of plug-in part is equipped on first installation part 11, and a matching, corresponding type of plug-in part is equipped on second installation part 21 so that the two plug-in parts may be mechanically interconnected to one another. Additional plug-in parts may be included on the other sides of the suitcases to facilitate the interconnection of additional suitcases (e.g., the interconnection of 3, 4, etc. suitcases together).

Figure 8:
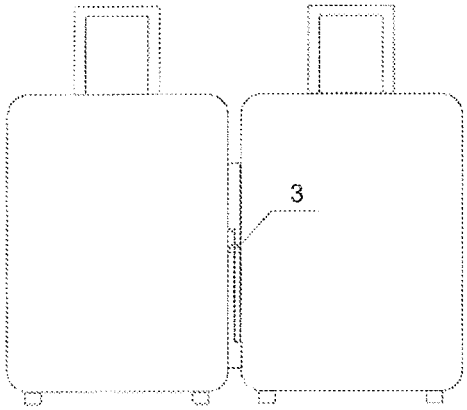
FIG. 8 is yet another schematic illustration of the improved travel suitcase system of the present invention.

FIG. 8 shows another illustration of the present invention, in which a positional part 3 is equipped on installation part 21 and is used to prevent sliding of the installation parts during movement of the suitcases.

Figure 9:
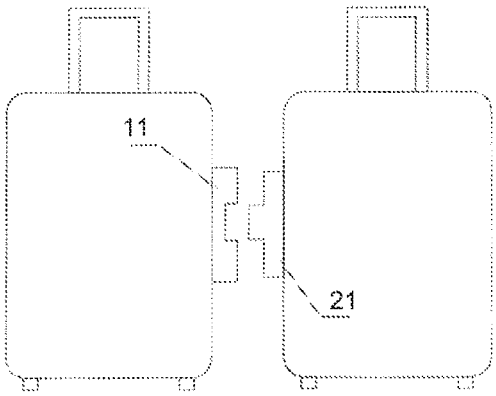
FIG. 9 is still a further schematic illustration of the improved travel suitcase system of the present invention.

FIG. 9 shows another illustration of the present invention. As shown in FIG. 9, first installation part 11 and second installation part 21 employ concave-convex type parts. In particular, first installation part 11 may be a concave part and second installation part 21 may be a convex part that is connectable to the concave part. The combination use of the concave-convex parts couple the two suitcases together, and positioning part 3 may then be equipped on the concave-convex parts in order to improve stability and avoid sliding of the parts during movement.

Figure 10:
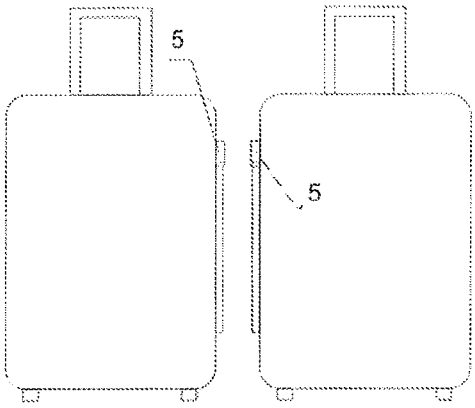
FIG. 10 is still another schematic illustration of the improved travel suitcase system of the present invention.

FIG. 10 shows another illustration of the present invention. As shown in FIG. 10, first installation part 11 and second installation part 21 may be connected via a slide rail. In such version, first installation part 11 and second installation part 21 are a chain wheel 5 and a slide way 6. The combined use of chain wheels couple the two suitcases together, and a positioning part 3 may be utilized on slide way 6 to avoid sliding, wherein the aforementioned connection could be actualized through a drawer slide rail.

Figure 11:
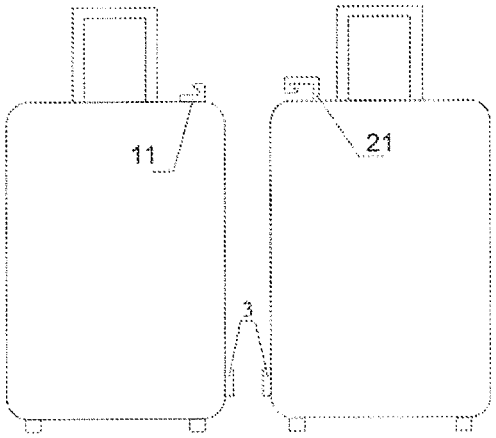
FIG. 11 is still yet another schematic illustration of the improved travel suitcase system of the present invention.

FIG. 11 shows another illustration of the present invention. As shown in the version of FIG. 11, first installation part 11 and second installation part 21 are connected using a buckle and hook type connection (or a hook and loop type connection). First installation part 11, which is a buckle, is equipped on the side of the extend-retract handle and the second installation part 21, which is a hook, is equipped at an appropriate place on the other suitcase. Then, the two suitcases are coupled together using the buckle and hook connectors.

In addition, in other variations, first installation part 11 and second installation part 21 may be snap-button type connectors, so that two or more suitcases are connected together using such snap buttons.

As will be appreciated, the terms "include," "contain," or the like represent non-limiting terms and, thus, the embodiments and all variations described herein may include other components and elements, and manners of interconnection and stability.

Having described the present invention including various features and variations thereof, it is intended that the appended claims be interpreted as including the embodiments described herein, the alternatives mentioned above, and all equivalents thereto.

What is claimed is:

1. An improved travel suitcase system, comprising:

a first suitcase including a first set of wheels coupled to a bottom of the first suitcase, a first installation part and a first extendable handle; and a second suitcase including a second set of wheels coupled to a bottom of the second suitcase, a second installation part and a second extendable handle;

wherein the installation parts are configured to releasably couple the first and second suitcases;

wherein the respective extendable handles of the first and second suitcases are disposed on the respective installation parts of the first and second suitcases;

wherein when the first and second suitcases are coupled via the installation parts, the extendable handles are adjacent to each other and align with each other so as to be configured as a single handle adapted to be gripped by a single hand of a user and the coupled suitcases are moveable together on the first and second sets of wheels via the single handle gripped by the single hand of the user.

2. The improved travel suitcase system of claim 1, wherein the first installation part is disposed on a side face of the first suitcase; and the second installation part is disposed on a side face of the second suitcase that is opposite of the side face of the first suitcase when the first and second suitcases are coupled together.

3. The improved travel suitcase system of claim 1, further comprising a positioning part that fixes the installation parts together.

4. The improved travel suitcase system of claim 1, wherein when the first and second suitcases are coupled together, the extendable handles are parallel to one another.

5. The improved travel suitcase system of claim 1, wherein when the first and second suitcases are coupled together, the first and second suitcases are immediately adjacent to one another and there is no gap between the first and second suitcases.

6. The improved travel suitcase system of claim 1, further comprising a connecting piece attached to both of the respective extendable handles of the first and second suitcases.

7. The improved travel suitcase system of claim 1, wherein the installation parts of the first and second suitcases are magnetic-type connectors for coupling the first and second suitcases.

8. The improved travel suitcase system of claim 1, wherein the extendable handles of the first and second suitcases include therein a magnet for providing additional coupling of the first and second suitcases.

9. The improved travel suitcase system of claim 8, wherein at least one of the extendable handles of the first and second suitcases includes therein the magnet along its length.

* * * * *